US005270157A

United States Patent [19]

Bell et al.

[11] Patent Number: 5,270,157

[45] Date of Patent: Dec. 14, 1993

[54] PHOTOGRAPHIC SILVER HALIDE MATERIAL

[75] Inventors: Peter Bell; Cuong Ly, both of Köln, Fed. Rep. of Germany

[73] Assignee: Bayer Aktiengesellschaft, Leverkusen, Fed. Rep. of Germany

[21] Appl. No.: 951,920

[22] Filed: Sep. 28, 1992

[30] Foreign Application Priority Data

Oct. 12, 1991 [DE] Fed. Rep. of Germany ..... 4133823

[51] Int. Cl.[5] ..... G03C 1/46

[52] U.S. Cl. ..... 430/505; 540/957; 540/567

[58] Field of Search ..... 430/957, 505, 567, 544

[56] References Cited

U.S. PATENT DOCUMENTS 4,173,479 11/1979 Ranz et al. ..... 430/507
4,495,277 1/1985 Becker et al. ..... 430/567
4,590,155 5/1986 Klotzer ..... 430/567
4,812,389 3/1989 Sakanoue et al. ..... 430/957
5,155,017 10/1992 Sato et al. ..... 430/567

FOREIGN PATENT DOCUMENTS 0345553 12/1989 European Pat. Off. .

*Primary Examiner*—Charles L. Bowers, Jr.
*Assistant Examiner*—Gerald Letscher
*Attorney, Agent, or Firm*—Connolly and Hutz

[57] ABSTRACT

A colour photographic silver halide material having at least one silver halide emulsion layer which contains at least one colour coupler and in which the silver halide grains contain from 40 to 90 mol. % of AgCl and at least two zones differing in halide composition, the chloride content of the outer zone being at least 10 mol. % higher than that of the inner zone, which silver halide emulsion layer is associated with a DIR compound whose reaction with the oxidized colour developer has a rate constant $k>2000$ [1/mol.s] is distinguished by excellent sharpness and colour reproduction even when processed by a high speed process.

7 Claims, No Drawings

PHOTOGRAPHIC SILVER HALIDE MATERIAL

This invention relates to a colour photographic silver halide material having at least one silver halide emulsion layer which contains a colour coupler and in which the silver halide grains have a layered grain structure, which silver halide emulsion layer is associated with a DIR compound whose reaction with the oxidized colour developer proceeds with a high rate constant.

It is known that silver halide emulsions having a high silver chloride content can be developed within a shorter time than those having a low silver chloride content. These rapid processes have, however, the disadvantage of adversely affecting sharpness and colour reproduction. Attempts to overcome these disadvantages by means of so-called DIR compounds, i.e. compounds which split off a development inhibiting compound in the reaction with oxidized colour developer, do not produce the desired result in conventional emulsions having a high chloride content.

It was an object of the present invention to provide a colour photographic silver halide material which can be developed by a high speed process and yet have excellent sharpness and colour reproduction.

This problem was unexpectedly solved by using certain DIR compounds in combination with silver halide emulsions which have a minimum AgCl content and a layered grain structure.

The invention therefore relates to a colour photographic silver halide material having at least one silver halide emulsion layer which contains at least one colour coupler and in which the silver halide grains contain from 40 to 90 mol. % of AgCl and at least two zones of differing halide composition, the chloride content of the outer zone being at least 10 mol. % higher than that of the inner zone, which silver halide emulsion layer is associated with a DIR compound whose reaction with the oxidized colour developer has a rate constant $k>2000$ [1/mol.s].

A region is referred to as a zone if it comprises at least 5 mol. % of the total silver halide content, preferably at least 10 mol. %. In addition, the silver halide grains may contain layers of differing halide composition amounting to less than 5 mol. % of the total quantity of silver halide.

In addition to silver chloride, the silver halide grains contain mainly silver bromide and optionally up to 15 mol. % of silver iodide. The emulsions are preferably AgBrCl emulsions.

Each zone preferably contains at least 10 mol. % of silver halide, in particular at least 20 mol. %.

Some types of emulsions according to the invention are described below:

Emulsion 1: Silver chlorobromide emulsion having an average particle diameter of 1.60 μm, a distribution coefficient of 77%, a core (Zone 1) of AgBr and a shell (Zone 2) of AgCl, the core amounting to 30 mol. %.

Emulsion 2: Silver chlorobromide emulsion having an average particle diameter of 1.70 μm and a distribution coefficient of 77%, a core of AgBr, a first shell of AgCl and a second shell of AgBr, the core amounting to 25 mol. % and the first shell to 70 mol. %.

Emulsion 3: Silver iodochlorobromide emulsion having an average particle diameter of 1.82 μm and a distribution coefficient of 60%, a core of $AgBr_{0,9}I_{0,1}$, a first shell of AgBr and a second shell of AgCl, the core amounting to 10 mol. % and the first shell to 20 mol. %.

Emulsion 4: Silver chlorobromide emulsion having an average particle diameter of 1.75 μm, a distribution coefficient of 80%, a core of AgBr, a first shell of $AgBr_{0,05}Cl_{0,95}$ and a second shell of $AgBr_{0,5}Cl_{0,5}$, the core amounting to 10 mol. % and the first shell to 80 mol. %.

The boundaries between zones differing in halide composition may be sharp or diffuse. If the boundary is diffuse, the boundary between adjacent zones is defined by the fact that at the boundary the halide content of a particular halide is equal to the average value of the halide contents of the same halide of the homogeneous regions of the adjacent zones.

The zones of differing chloride contents result from the precipitation conditions.

The silver halide may consist of predominantly compact crystals which may, for example, be regular cubes or octahedrons or transitional forms. Plate-shaped crystals having an average ratio of diameter to thickness of preferably 5:1 may also be present, the diameter of a grain being defined as the diameter of a circle having a surface area equal to the projected surface of the grain. The layers may also contain tabular silver halide crystals in which the ratio of diameter to thickness is greater than 5:1, e.g. from 12:1 to 30:1.

The average grain size of the emulsion is preferably from 0.2 μm to 2.0 μm and the grain size distribution may be either homodisperse or heterodisperse. The emulsions may contain organic silver salts in addition to the silver halide, e.g. silver benzotriazolate or a silver behenate.

Particularly preferred are monodisperse emulsions in which at least 70% of the spheres having the same volume as the emulsion grains have diameters with a value from 0.8 to 1.3 times the most frequently occurring sphere diameter. The distribution is determined by electrolytic methods (DE-A 2 025 147).

Two or more types of separately prepared silver halide emulsions may be used as mixtures.

The photographic emulsions may be prepared from soluble silver salts and soluble halides by various methods (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966)).

Precipitation of the silver halide is preferably carried out in the presence of a binder, e.g. gelatine, and may be carried out at an acid, neutral or alkaline pH, preferably with the additional use of silver halide complex former. Examples of the latter are ammonia, thioethers, imidazole, ammonium thiocyanate and excess halide. The composition of the water-soluble silver salts and of the halides may be prepared successively by the single jet process or simultaneously by the double jet process or by any combination of the two processes. The substances are preferably introduced at increasing inflow rates but without exceeding the "critical" inflow rate at which new nuclei are just prevented from forming. The pAg range may vary within wide limits during the precipitation; the so-called pAg-controlled process is preferably employed in which the pAg is kept constant at a certain value or passes through a predetermined pAg profile during the precipitation. So-called inverse precipitation with an excess of silver ions may also be used instead of the preferred precipitation with an excess of halide. Growth of the silver halide crystals may be achieved not only by precipitation but also be physical ripening (Ostwald ripening) in the presence of excess halide and/or silver halide complex forming agents. The growth of emulsion grains may in fact take place predominantly by Ostwald ripening, in which a fine grained, so-called Lippmann emulsion is preferably mixed with a more sparingly soluble emulsion and dissolved and reprecipitated on the latter.

Salts or complexes of metals such as Cd, Zn, Pb, Tl, Bi, Ir, Rh or Fe may be present during the precipitation and/or physical ripening of the silver halide grains.

Precipitation may also be carried out in the presence of sensitizing dyes. Complex forming agents and/or dyes may be rendered ineffective at any stage, e.g. by altering the pH or by an oxidative treatment.

The binder used is preferably gelatine but this may be partly or completely replaced by other synthetic, semi-synthetic or naturally occurring polymers. Examples of synthetic gelatine substitutes include polyvinyl alcohol, poly-N-vinylpyrrolidone, polyacrylamides, polyacrylic acid and derivatives thereof, in particular the copolymers thereof. Examples of naturally occurring gelatine substitutes include other proteins such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose and gelatine derivatives which have been obtained by a reaction with alkylating or acylating agents or by the grafting of polymerisable monomers are examples of these.

The binders should have a sufficient quantity of functional groups to enable sufficiently resistant layers to be produced by a reaction with suitable hardeners. These functional groups are in particular amino groups but may also be carboxyl groups, hydroxyl groups and active methylene groups.

Gelatine, which is preferably used, may be obtained by acid or alkaline decomposition. The preparation of such gelatines is described, for example, in "The Science and Technology of Gelatine" published by A. G. Ward and A. Courts, Academic Press 1977, pages 295 et seq. The gelatine used should be as far as possible free from photographically active impurities (inert gelatine). Gelatines having a high viscosity and low swelling are particularly advantageous. The gelatine may be partly or completely oxidized.

When crystal formation has been completed, or at an earlier stage, the soluble salts are removed from the emulsion, e.g. by shredding and washing, by flocculation and washing, by ultrafiltration or by means of ion exchangers.

The photographic emulsions may contain compounds for preventing fogging or for stabilizing the photographic function during production, storage or photographic processing.

Azaindenes are particularly suitable, especially tetra- and pentaazaindenes, and particularly those which are substituted with hydroxyl or amino groups. Compounds of this type have been described, e.g. by Birr, Z. Wiss. Phot. 47 (1952), pages 2–58. Salts of metals such as mercury or cadmium, aromatic sulphonic or sulphinic acids such as benzene sulphinic acid, or nitrogen-containing heterocyclic compounds such as nitrobenzimidazole, nitroindazole, (substituted) benzotriazoles or benzothiazolium salts may also be used as anti-foggants. Heterocyclic compounds containing mercapto groups are particularly suitable, e.g. mercaptobenzothiazoles, mercaptobenzimidazoles, mercaptotetrazoles, mercaptothiadiazoles or mercaptopyrimidines. These mercaptozoles may also contain a water solubilizing group, e.g. a carboxyl group or a sulpho group. Other suitable compounds are published in Research Disclosure No. 17643 (1978), Section VI.

The stabilizers may be added to the silver halide emulsions before, during or after ripening of the emulsions. The compounds may, of course, also be added to other photographic layers which are associated with a silver halide layer.

Mixtures of two or more of the above-mentioned compounds may be used.

The silver halide emulsions are normally chemically ripened, for example by the action of gold compounds, other noble metal compounds, reducing agents and/or compounds of divalent sulphur.

The photographic emulsion layers or other hydrophilic colloid layers of the light-sensitive material prepared according to the invention may contain surface-active agents for various purposes, such as coating auxiliaries or agents to prevent electric charging, to improve the slip properties, for emulsifying the dispersion, to prevent adhesion and to improve the photographic characteristics (e.g. development acceleration, high contrast, sensitization, etc.).

The photographic emulsions may be spectrally sensitized with methine dyes or other dyes. Cyanine dyes, merocyanine dyes and complex merocyanine dyes are particularly suitable.

Sensitizers may be omitted if the intrinsic sensitivity of the silver halide for a particular spectral region is sufficient, for example the blue sensitivity of silver bromide.

Colour photographic materials normally contain at least one red-sensitive, at least one green-sensitive and at least one blue-sensitive emulsion layer. Non-diffusible monomeric or polymeric colour couplers are associated with these emulsion layers; these colour couplers may be situated in the same layer or in an adjacent layer. Cyan couplers are generally associated with the red-sensitive layers, magenta couplers with the green-sensitive layers and yellow couplers with the blue-sensitive layers. At least one of these layers preferably contains the combination according to the invention of emulsion and DIR compound. Preferably at least one red-sensitive as well as at least one green-sensitive and at least one blue-sensitive layer contain the combination of emulsion/DIR compound according to the invention.

Colour couplers for producing the cyan partial colour image are generally couplers of the phenol or α-naphthol series, preferably 2-ureidophenol compounds and 1,5-aminonaphthol compounds.

Colour couplers for producing the yellow partial colour image are generally couplers containing an open chain ketomethylene group, in particular couplers of the type of α-acylacetamide; preferred classes of couplers are α-benzoylacetanilide couplers and α-pivaloylacetanilide couplers, which are also known from the literature.

Colour couplers for producing the magenta partial colour image are generally couplers of the 5-pyrazolone, indazolone or pyrazoloazole series. Pyrazoloazole compounds and arylaminopyrazolo compounds belong to preferred classes of couplers.

The colour couplers may be 4-equivalent couplers or 2-equivalent couplers. The latter are derived from 4-equivalent couplers in that they contain in the coupling position a substituent which is split off in the coupling reaction. 2-Equivalent couplers include colourless couplers as well as couplers which have an intense colour of their own which disappears in the process of colour coupling to be replaced by the colour of the image dye produced (masking couplers), for example, red masking couplers for a cyan coupler and a dye having an absorption range of 510 to 590 nm attached via an oxygen atom and optionally a linking member in the coupling position, and white couplers which result in substantially colourless products in their reaction with colour developer oxidation products. The DIR couplers with high coupling velocity used according to the invention are also 2-equivalent couplers.

Examples of high molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. The high molecular weight colour couplers are generally prepared by the polymerisation of ethylenically unsaturated monomeric colour couplers but they may also be obtained by polyaddition or polycondensation.

Couplers and other compounds may be incorporated in silver halide emulsion layers by first preparing a solution, dispersion or emulsion of the particular compound and then adding this to the casting solution for the layer. The choice of suitable solvent or dispersing agent depends on the solubility of the compound.

Methods of introducing substantially water-insoluble compounds by means of grinding processes are described, for example, in DE-A-2 609 741 and DE-A-2 609 742.

Hydrophobic compounds may also be introduced into the casting solution by using high boiling solvent, so-called oil formers. Suitable methods are described, for example, in US-A-2 322 027, US-A-2 801 170, US-A-2 801 171 and EP-A-0 043 037.

Oligomeric or polymeric, so-called polymeric oil formers may be used instead of high boiling solvents.

The compounds may also be introduced into the casting solution in the form of charged latices; see, for example, DE-A-2 541 230, DE-A-2 541 274, DE-A-2 835 856, EP-A-0 014 921, EP-A-0 069 671, EP-A-0 130 115 and US-A-4 291 113.

Diffusion-fast incorporation of anionic, water-soluble compounds (e.g. dyes) may also be achieved by means of cationic polymers, so-called mordant polymers.

Examples of suitable oil formers for other couplers and other compounds include phthalic acid alkyl esters, phosphoric acid esters, citric acid esters, benzoic acid esters, alkylamides, fatty acid esters and trimesic acid esters.

A photographic material typically comprises at least one red-sensitive emulsion layer, at least one green-sensitive emulsion layer and at least one blue-sensitive emulsion layer on a support. The sequence of these layers may be varied as desired. Couplers giving rise to cyan, magenta and yellow dyes are normally incorporated with the red-sensitive, green-sensitive and blue-sensitive emulsion layers, respectively, but other combinations may also be used.

Each of the light-sensitive layers may consist of a single layer or two or more silver halide emulsion partial layers (DE-C-1 121 470). Red-sensitive silver halide emulsion layers are frequently arranged closer to the layer support than green-sensitive silver halide emulsion layers, which in turn are arranged closer to the support than blue-sensitive layers, and a light-insensitive yellow filter layer is generally placed between the green-sensitive layers and the blue-sensitive layers.

If the green-sensitive and red-sensitive layers have a sufficiently low intrinsic sensitivity, the yellow filter layer may be omitted and other layer arrangements may be chosen in which, for example, the blue-sensitive layers are closest to the support, followed by the red-sensitive and then the green-sensitive layers.

The light-insensitive interlayers generally arranged between layers differing in their spectral sensitivity may contain substances which prevent unwanted diffusion of developer oxidation products from one light-sensitive layer to another light-sensitive layer having a different spectral sensitization.

If several partial layers of the same spectral sensitization are present, these may differ from one another in their composition, in particular the type and quantity of the silver halide grains. The partial layer having the higher sensitivity is generally arranged further away from the support than the partial layer with the lower sensitivity. Partial layers having the same spectral sensitization may be arranged adjacent to one another or separated by other layers, e.g. layers of a different spectral sensitization. Thus, for example, all highly sensitive layers may be combined in a single layer packet and all low sensitive layers in another layer packet (DE-A 1 958 709, DE-A 2 530 645, DE-A 2 622 922).

The photographic material may contain UV light-absorbent compounds, white toners, spacers, filter dyes, formalin acceptors and other substances.

UV Light absorbent compounds should protect the image dyes from being bleached by daylight with a high UV content and at the same time act as filter dyes to absorb the UV light when the film is exposed in daylight and thereby improve the colour reproduction of the film. Compounds with different structures are normally used for these two different functions. Examples include aryl substituted benzotriazole compounds (US-A 3 533 794), 4-thiazolidone compounds (US-A 3 314 794 and 3 352 681), benzophenone compounds (JP-A 2784/71), cinnamic acid ester compounds (US-A 3 705 805 and 3 707 375), butadiene compounds (US-A 4 045 229) or benzoxazole compounds (US-A 3 700 455).

Ultraviolet absorbent couplers (such as cyan couplers of the α-naphthol series) and ultraviolet absorbent polymers may also be used. These ultraviolet absorbents may be fixed in a particular layer by mordanting.

Filter dyes suitable for visible light include oxonole dyes, hemioxonole dyes, styrene dyes, merocyanine dyes, cyanine dyes and azo dyes. Among these dyes, oxonole dyes, hemioxonole dyes and merocyanine dyes are particularly suitable.

Suitable white toners are described, for example, in Research Disclosure, December 1978, pages 22 et seq, Report 17643, Chapter V.

Certain binder layers, in particular the layer which is furthest removed from the support but occasionally also interlayers, especially if they are furthest away from the support during the preparation of the layers, may contain photographically inert particles of an inorganic or organic nature, e.g. as matting agents or as spacers (DE-A 3 331 542, DE-A 3 424 893, Research Disclosure, December 1978, pages 22 et seq, Report 17643, Chapter XVI).

The average particle diameter of the spacers is in particular in the range of from 0.2 to 10 μm. The spacers are insoluble in water and may be soluble or insoluble in alkalies; those which are soluble in alkalies are generally removed from the photographic material in the alkaline development bath. Examples of suitable polymers include polymethyl methacrylate, copolymers of acrylic acid and methyl methacrylate and hydroxypropyl methyl cellulose hexahydrophthalate.

The binders of the material according to the invention, especially gelatine, are hardened with suitable hardeners, for example hardeners of the epoxide series, the ethylene imine series, the acryloyl series or the vinyl sulphone series. Hardeners of the diazine, triazine or 1,2-dihydroquinoline series are also suitable.

The binders of the material according to the invention are preferably hardened with instant hardeners.

Instant hardeners are compounds which are capable of cross-linking binders at such a rate that hardening is sufficiently completed immediately after casting but at the latest after 24 hours, preferably not later than 8 hours, so that no further change in the sensitometry or swelling of the combinations of layers occurs due to a cross-linking reaction. The swelling is the difference between the wet layer thickness and the dry layer thickness when a film is processed under aqueous conditions (Photographic Sci. Eng. 8 (1964), 275; Photographic Sci. Eng. (1972), 449).

These hardeners which react very rapidly with gelatine may be, for example, carbamoyl pyridinium salts which are capable of reacting with the free carboxyl groups of gelatine so that the latter react with free amino groups of gelatine to form peptide bonds with cross-linking of the gelatine.

Suitable examples of instant hardeners are, for example, compounds corresponding to the following general formulae

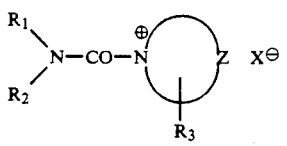

(a)

wherein $R_1$ denotes alkyl, aryl or aralkyl, $R_2$ has the same meaning as $R_1$ or denotes alkylene, arylene, aralkylene or alkaralkylene in which the second bond is linked with a group of the formula

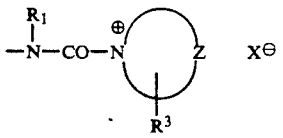

or $R_1$ and $R_2$ together denote the atoms required for completing an optionally substituted heterocyclic ring, for example a piperidine, piperazine or morpholine ring, which ring may be substituted, e.g. by $C_1$–$C_3$-alkyl or halogen, $R_3$ stands for hydrogen, alkyl, aryl, alkoxy, $NR_4$—$COR_5$, $(CH_2)_m$—$NR_8R_9$, $(CH_2)_n$—$CONR_{13}R_{14}$ or $$(CH_2)_p-\underset{\underset{R_{15}}{|}}{CH}-Y-R_{16}$$

or a bridging member or a direct link to a polymer chain, $R_4$, $R_6$, $R_7$, $R_9$, $R_{14}$, $R_{15}$, $R_{17}$, $R_{18}$ and $R_{19}$ denoting hydrogen or $C_1$–$C_4$-alkyl, $R_5$ denoting hydrogen, $C_1$–$C_4$-alkyl or $NR_6R_7$, $R_8$ denoting $COR_{10}$, $R_{10}$ $NR_{11}R_{12}$, $R_{11}$ $C_1$–$C_4$-alkyl or aryl, in particular phenyl, $R_{12}$ hydrogen, $C_1$–$C_4$-alkyl or aryl, in particular phenyl, $R_{13}$ hydrogen, $C_1$–$C_4$-alkyl or aryl, in particular phenyl, $R_{16}$ hydrogen, $C_1$–$C_4$-alkyl, $COR_{18}$ or $CONHR_{19}$, m denotes a number from 1 to 3, n denotes a number from 0 to 3, p denotes a number from 2 to 3 and Y stands for O or $NR_{17}$, or $R_{13}$ and $R_{14}$ together denote the atoms required for completing an optionally substituted heterocyclic ring, for example a piperidine, piperazine or morpholine ring, which ring may be substituted, e.g. by $C_1$–$C_3$-alkyl or halogen, Z denotes the carbon atoms required for completing a 5-membered or 6-membered aromatic heterocyclic ring, optionally with condensed benzene ring, and $X^{\ominus}$ denotes an anion, which is omitted when an anionic group is already linked to the remainder of the molecule;

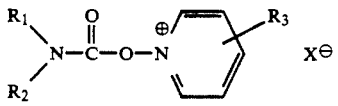

(b)

wherein $R_1$, $R_2$, $R_3$ and $X^{\ominus}$ have the meaning indicated for formula (a).

The method of measuring the coupling rate is indicated in DE-OS-2 704 797. The method of measurement and the apparatus required for determining the coupling rate constants of the couplers and DIR couplers used in the material according to the invention are described below.

It has been found that the relative reaction velocity constants of a coupler or DIR coupler determined by one of the known methods may assume different values, depending on how these compounds are dispersed. Thus one and the same coupler could be used either as an aqueous alkaline solution or in the form of an emulsion prepared by means of a so-called coupler solvent or oil former. Hydrophobic couplers may be prepared in the form of aqueous dispersions which may be prepared with the aid of low boiling organic solvents or they may be used in the form of the above-mentioned emulsions. When emulsifiers are used, the k-value may depend on the nature and quantity of the solvent (oil former) and on the nature of the wetting agent and the size of the droplets. For this reason it is desired to use the effective rate constant ($k_{eff}$) of the couplers in their given form of as criterion for deciding the usefulness of the couplers or DIR couplers for the present invention. For determining the relative rate, the coupler is therefore preferably used in the same form of dispersion in which it will also be used in the colour photographic material.

An electrochemical process has been developed by which the reactivity of dissolved or emulsified couplers can be determined approximately in vitro in the form of an effective rate constant ($k_{eff}$[1/mol.sec]). The consumption of the developer oxidation product is a measure of the reactivity and can be determined by measuring the redox potential in a "stopped flow" apparatus. The $k_{eff}$-values given in the present description were determined by the method described below.

The measuring apparatus required consists of two cylindrical storage containers about 25 cm in height having supply pipes leading to a mixing chamber. These pipes are equipped with non-return valves. A pipe leads from the mixing chamber via a magnetic valve, which is closed when the apparatus is at rest and can be opened by a pulse generator, to a receiving vessel in which a vacuum is produced and maintained. A measuring electrode is provided between the mixing chamber and the receiving vessel and a reference electrode is arranged between the mixing chamber and a storage vessel. The electrodes are connected to a digital mV meter and a recording device. A sketch of such an apparatus is described in EP-A-329 016.

The magnetic valve is opened for a time t by the pulse generator. Due to the pressure gradient between the receiving vessel and the storage containers, the liquids contained in the latter flow via the supply pipes into the mixing chamber where intensive mixing takes place. The mixture then passes through the magnetic valve into the receiving vessel. The first storage container contains an oxidizing agent, e.g. a $10^{-3}$ molar aqueous solution of $K_3[Fe(CN)_6]$. The second storage container contains a colour developer, the coupler to be investigated and means for adjusting the pH to the desired level (buffer), all in aqueous solution. The special colour developer used was $N^1$-ethyl-$N^1$-(2-hydroxyethyl)-3-methyl-1,4-diammonium sulphate (monohydrate) CD=4 (concentration: $2\times10^{-3}$ mol/l). The concentration of the coupler to be measured was $10^{-3}$ mol/l. Couplers which are not soluble in water may be used in the form of an emulsion, prepared in known manner, of coupler, coupler solvent and hydrophilic binder. The pH was adjusted to 10.2 by means of a carbonate/bicarbonate buffer.

The redox potential in the mixture is measured by means of the measuring electrode (platinum wire $\phi$1 mm). An Ag/AgCl electrode is used as reference electrode (e.g. Argenthal cartridge). In this particular embodiment, this reference electrode is situated in the supply pipe leading from the second storage container to the mixing chamber, but it could equally well be arranged in the usual position next to the platinum electrode. The redox potential measured in the mixed solutions may be read off by means of the digital-mV meter and its variation with time may be recorded by means of the recording device (compensation writer, oscillograph, light point line writer).

To determine the change in redox potential with time, the redox potential measured is entered in mV (ordinate) against the time in sec (abscissa).

t stands for the opening time of the magnetic valve. The effective rate constant $k_{eff}$ can be calculated from the angle o according to the following equation:

$$k_{eff} = \frac{1}{K_0 \cdot f}(tg\alpha_K - tg\alpha_0).$$

In this equation, $k_{eff}$ stands for rate constant [1/mol.sec]

$K_0$ stands for initial concentration of coupler (mol/l)

f stands for electrochemical constant $$\left(f = \frac{R \cdot T}{n \cdot F}\right)$$

$\alpha_K$ stands for the angle $\alpha$ obtained when coupler is present and $\alpha_0$ stands for the angle $\alpha$ obtained when no coupler is present.

After the solutions have been introduced into the storage containers, the mixing chamber and the inflow and discharge pipes are vigorously washed while the magnetic valve is kept open and the containers are then refilled to their original level. The potential/time curve can then be drawn up by briefly opening the magnetic valve. The angle $\alpha$ between the time axis and the tangent to the measuring curve at the beginning of the reaction is determined, once with the coupler to be measured ($\alpha_K$) and another time without coupler ($\alpha_0$). The effective rate constant $k_{eff}$ can be determined by inserting the two values in the above equation.

The method may, of course, be modified in numerous ways. Thus different colour developers may be used or the reaction may be carried out at different pH values. To measure the reactivity of couplers which are very rapidly oxidized to ferricyanide, the apparatus may be modified in that two mixing chambers arranged in series may be used instead of only one mixing chamber. In that case, the developer oxidation product is produced in the first mixing chamber by mixing the developer with ferricyanide, and this developer oxidation product is then mixed in the second mixing chamber with the coupler to be measured. The measuring electrode mainly measures the concentration of developer oxidation product, which is presumably the quinone diimine of the colour developer used. For the basic principles of redox measurement see, for example, J. Eggers "Über die Folgereaktionen bei der Oxidation von p-Amino-N-dialkylanilinen" in "Mitteilungen aus den Forschungslaboratorien der Agfa", Volume III, page 73 (1961).

The couplers and DIR couplers are converted as described below into an emulsion which is used for carrying out the measurements described above:

2 g of Coupler are dissolved in 8 ml of a solvent mixture consisting of one part of dibutylphthalate, three parts of ethyl acetate and 0.1 part of sulphosuccinic acid di-n-octyl ester (Mannoxol) and emulsified in 37.5 g of 7.5% gelatine. The emulsion is then stirred for 6 minutes at about 1000 revs/min, in which process it heats up to a maximum of 60° C., and the ethyl acetate is then removed by suction filtration in a water jet vacuum (200–300 mbar). The reaction mixture is then made up to 60 g with water. From this solution is removed a portion corresponding to 1 mmol of coupler and made up to 100 g with 4% by weight aqueous gelatine solution. 20 ml of solution are used for each measurement.

The coupling rate constants hereinafter denoted by k are the effective rate constants $k_{eff}$ determined by the method described above.

The DIR compounds to be used according to the invention correspond in particular to the following formula $$A-(L)_n-B$$

wherein

A denotes the residue of a compound which releases group $(L)_n-B$ in its reaction with the oxidation product of colour developer, in particular the residue of a coupler which releases the group $(L)_n-B$ in the coupling reaction.

B denotes the residue of a development inhibitor which is released from the group $(L)_n-B$, L is a divalent linking member which is capable of breaking the L—B bond after the A—L bond has been broken and n stands for 0 or 1.

Preferred residues B correspond to the following formulae:

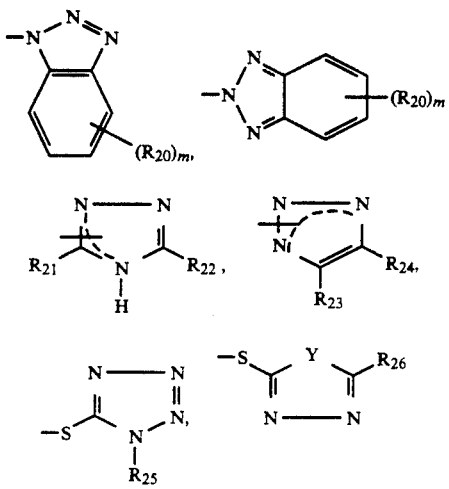

wherein

Y stands for O, S or $NR_6$, $R_{20}$ denotes H, a substituted or unsubstituted, straight chain, branched or cyclic aliphatic group, halogen, $NHCOR_{33}$, $OR_{33}$,

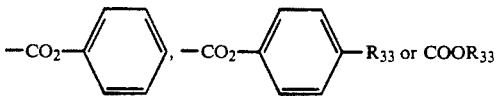

$R_{21}$ denotes H, halogen, a substituted or unsubstituted straight chain, branched or cyclic aliphatic group, $SR_{33}$, S-aryl or S-hetaryl, $R_{22}$ denotes a substituted or unsubstituted, straight chain, branched or cyclic aliphatic group, $SR_{33}$, aryl or hetaryl, $R_{23}$ denotes hydrogen, a substituted or unsubstituted straight chain, branched or cyclic aliphatic group or an aryl group, $R_{24}$ denotes a substituted or unsubstituted straight chain, branched or cyclic aliphatic group, $SR_{33}$ or $S-(CH_2)_n-COOR_{34}$, $R_{25}$ denotes a substituted or unsubstituted straight chain, branched or cyclic aliphatic group or a phenyl group which may be unsubstituted or substituted by hydroxy, amino, sulphamoyl, carboxy or methoxycarbonyl, $R_{26}$ denotes a substituted or unsubstituted, straight chain, branched or cyclic aliphatic group, aryl, hetaryl, $SR_{33}$ or an acylamino group, $R_{27}$ denotes H, a substituted or unsubstituted straight chain, branched or cyclic aliphatic group, aryl, an acylamino group or a benzylidene amino group, $R_{33}$ denotes a substituted or unsubstituted straight chain, branched or cyclic aliphatic group, $R_{34}$ denotes a substituted or unsubstituted straight chain, branched or cyclic aliphatic group or an optionally substituted aryl group, m stands for 1 or 2 and n stands for 1 to 4.

Preferred groups denoted by L—B correspond to the following formulae:

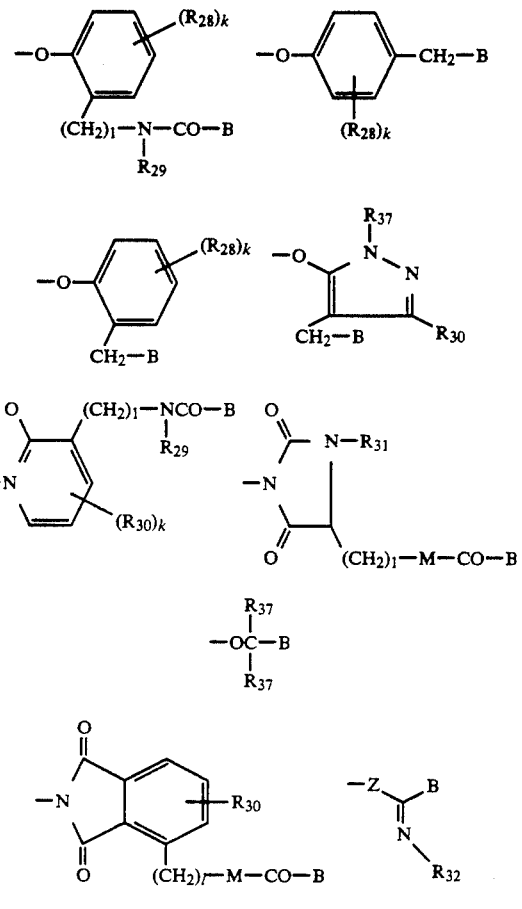

wherein k=1 or 2, l=0, 1 or 2, $R_{28}$ denotes hydrogen, alkyl, aryl, hetaryl, halogen, nitro, cyano, alkylthio, acylamino, sulphamoyl, alkoxycarbonylamino or amino, $R_{29}$ denotes hydrogen, alkyl, aryl or aralkyl, $R_{30}$ denotes hydrogen, halogen, alkyl, aralkyl, alkoxy, anilino, acylamino, ureido, cyano, sulphonamido, aryl or carboxy, $R_{31}$ denotes hydrogen, alkyl, aralkyl, cycloalkyl or aryl, M denotes —O— or

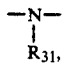

$R_{32}$ denotes alkyl, aralkyl, aryl, acyl, hetaryl, acylamino, $—OR_{35}$ or $—PO(OR_{35})_2$, $R_{35}$ denotes alkyl, aryl or hetaryl, Z denotes —O—, —S—or

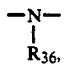

$R_{36}$ denotes hydrogen, alkyl, aryl, alkylsulphonyl or arylsulphonyl and $R_{37}$ denotes hydrogen, alkyl or aryl.

The substituents most preferably have the following meanings:

$R_{20}$=H, $CH_3$, Cl, Br, $C_1$–$C_6$-alkoxy, $C_1$–$C_6$-alkylcarbonylamino, phenoxycarbonyl, $R_{21}$=$C_1$–$C_{10}$-alkylthio, $R_{22}$=H, 2-furyl, $R_{23}$=H, $C_1$–$C_4$-alkyl, $R_{24}$=$C_1$–$C_6$-alkylthio, $C_1$–$C_8$-alkoxycarbonyl, $C_1$–$C_6$-alkylcarbonyloxy-$C_1$–$C_4$-alkylenethio, $R_{25}$=$C_1$–$C_6$-alkyl optionally substituted by di-$C_1$–$C_4$-alkylamino, or phenyl optionally mono- or di-substituted by hydroxy, $C_1$–$C_4$-alkyl, methoxycarbonyl, aminosulphonyl or chlorethoxycarbonyl, $R_{26}$=$C_1$–$C_6$-alkyl, amino, 2-furyl, $R_{27}$ =H, $C_1$–$C_6$-alkylcarbonylamino or

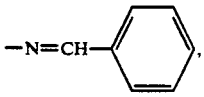

$R_{28}$=$NO_2$, $R_{29}$=$C_1$–$C_4$-alkyl, $R_{30}$=$C_1$–$C_{20}$-alkyl or phenyl, $R_{31}$=H, $C_1$–$C_4$-alkyl, $R_{32}$=phenyl optionally substituted by chlorine, $R_{37}$=phenyl, nitrophenyl, and Z=oxygen.

The linking group L may also be split off by a reaction with the oxidized product of a developer substance. Typical examples of such linking members are shown in the following general DIR coupler structures:

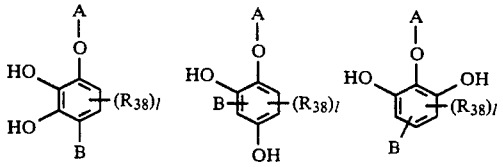

-continued

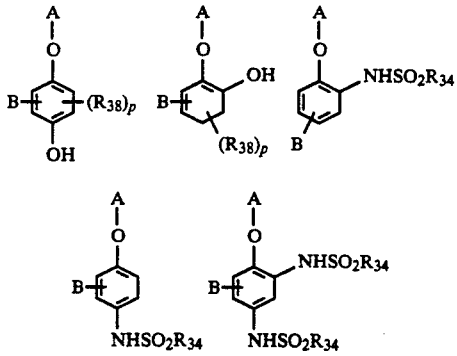

wherein $R_{38}$ denotes an aliphatic, aromatic or heterocyclic group or the group

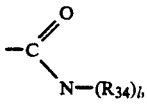

l may assume the value 0, 1 or 2 and p may assume the value 0, 1, 2 or 3.

Suitable DIR couplers for the material according to the invention are all those whose coupling rate constant $k \geqq 2\times10^3$, preferably $\geqq 5\times10^3$ [1/mol.sec] at the pH of the colour developer.

Examples of DIR couplers which are sufficiently rapid (coupling rate constant $k \leqq 2\times10^3$ [1/mol.sec.] at pH 10.2) and too slow ($k \leqq 2\times10^3$ l/mol.sec) may be found, for example, in the following Tables but the DIR couplers suitable for the material according to the invention are not to be restricted to the substances shown there.

Rapid DIR couplers of the following classes are preferred for the material according to the invention:

a) Yellow couplers of the benzoyl acetanilide series and/or pivaloyl acetanilide series and quinazolinone acetanilide series b) Magenta couplers of the pyrazolo azole series and acylaminopyrazolone series c) Cyan couplers of the 2-ureidophenol series and/or 5-amino-1-naphthol series d) Red masking couplers having an O-fugitive group corresponding to the following formula:

$$Cp—O—L_{(0-1)}-Dye$$

in which

Cp denotes a cyan coupler

L denotes a linking member and

Dye denotes a dye having a $\lambda_{max}$ from 510–590 nm.

| | | k |
|---|---|---|
| DIR-1 | see Example 1 | 4000 |
| DIR-2 | see Example 1 | 8000 |
| DIR-3 | see Example 2 | 1800 |
| DIR-4 | see Example 4 | 160 |
| DIR-5 | see Example 4 | 1000 |
| DIR-6 | see Example 4 | 3900 |

-continued
DIR-7
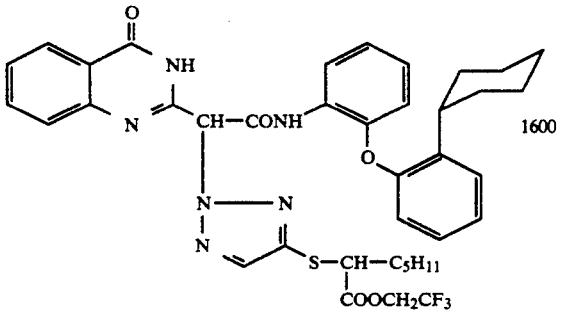
1600
DIR-8
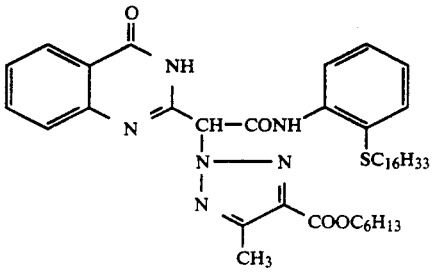
750
DIR-9
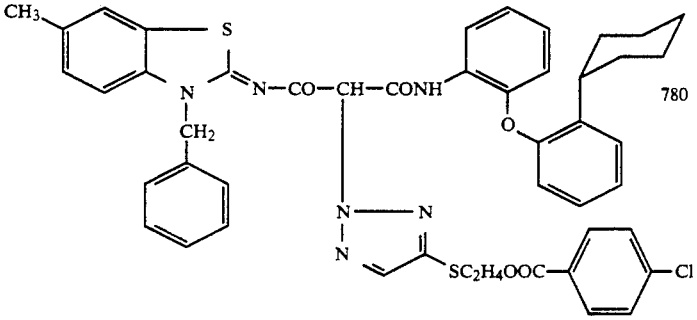
780
DIR-10
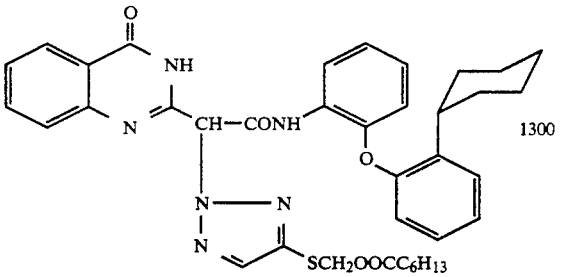
1300
DIR-11
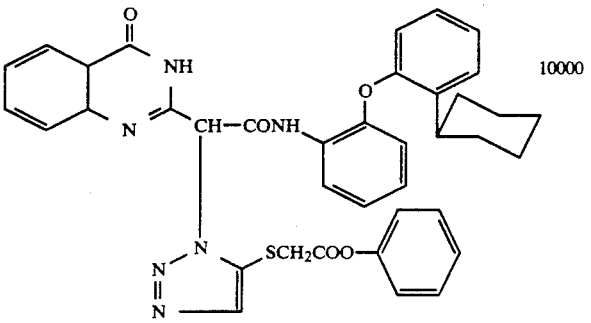
10000

-continued
DIR-12
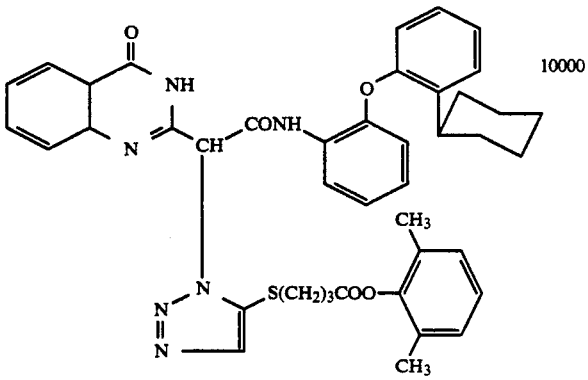
10000
DIR-13
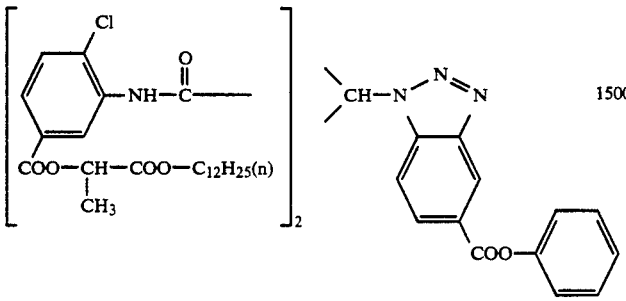
15000
DIR-14
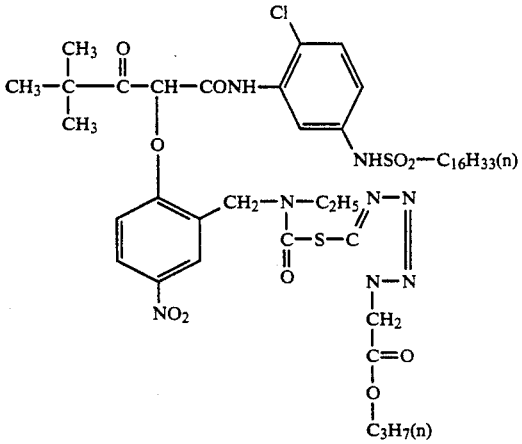
2400
DIR-15
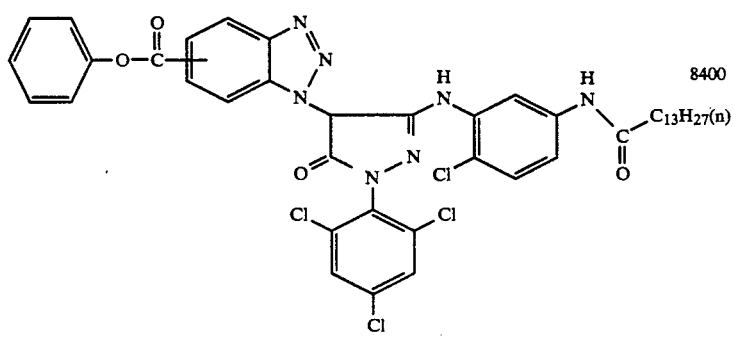
8400

-continued
DIR-16
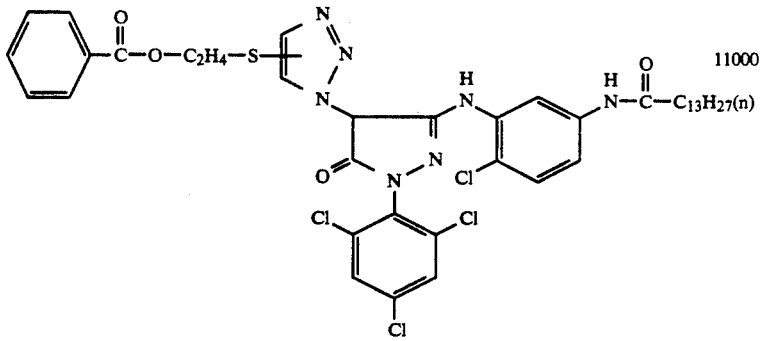
11000
DIR-17
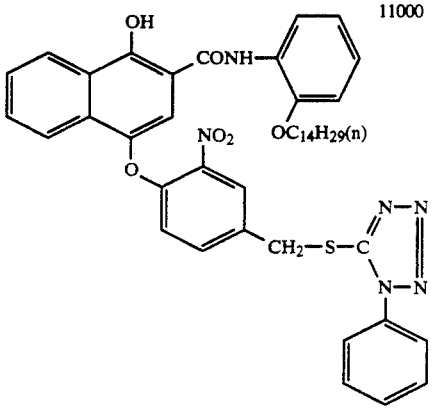
11000
DIR-18
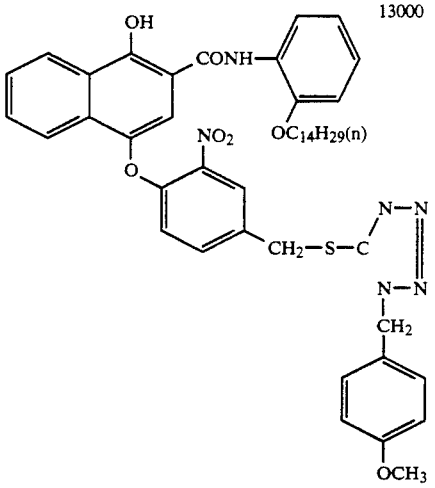
13000
DIR-19
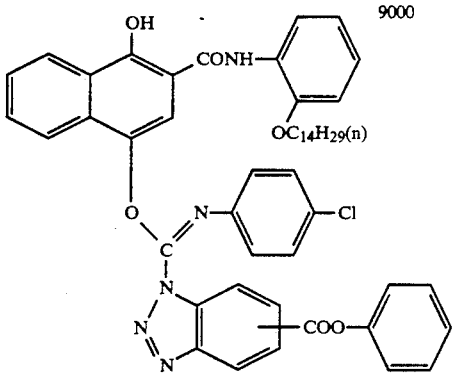
9000

-continued

DIR-20

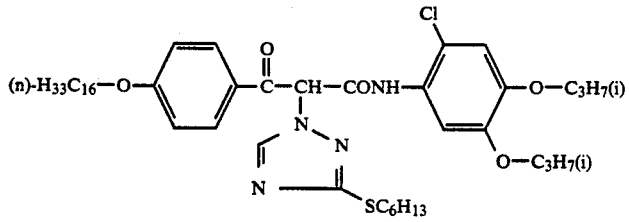

10000

DIR-21

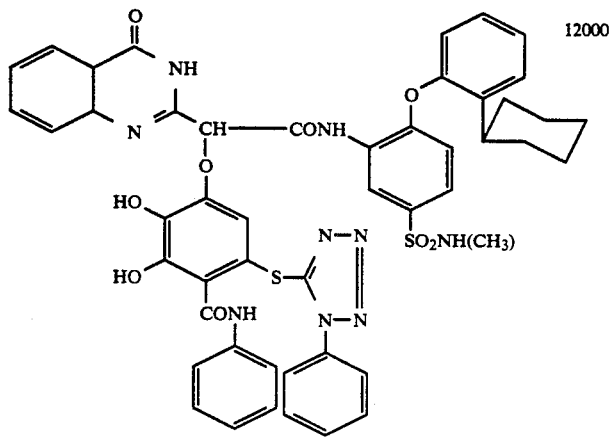

12000

Those DIR compounds whose inhibitors are highly diffusible are preferred for the material according to the invention.

A method of determining the diffusibility of the inhibitors split off from the DIR couplers is described in EP-A-115 302.

The diffusibility $D_f$ is determined by the following method for the purposes of the present invention:

Multilayered test materials A and B were prepared ss follows:

Test material A

The following layers are applied in the sequence given to a transparent layer support of cellulose triacetate. The quantities indicated are based on 1 $m^2$. The quantity of silver applied is given in terms of the corresponding quantity of $AgNO_3$. The silver halide emulsions are stabilized with 0.5 g of 4-hydroxy-6-methyl-1,3,3a,7-tetraazaindene per 100 g of $AgNO_3$.

Silver halide emulsion: Silver iodobromide emulsion containing 7 mol. % of iodide, average grain diameter 0.5 μm, cubical crystals with rounded corners.

Layer 1 Red sensitized silver halide emulsion of the type indicated, obtained from 4.57 g of $AgNO_3$ and 0.754 g of cyan coupler K dissolved in 0.6 g of dibutylphthalate and dispersed in 0.603 of gelatine Layer 2 Unsensitized silver halide emulsion from 2.63 g of $AgNO_3$, 0.38 g of white coupler L and 1.17 g of gelatine Layer 3 Protective layer containing 1.33 g of gelatine Layer 4 Hardening layer containing 0.82 g of gelatine and 0.54 g of hardening agent of the formula

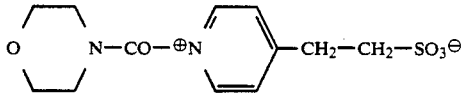

Cyan coupler K

-continued

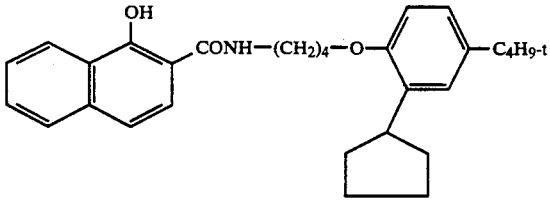

White coupler L

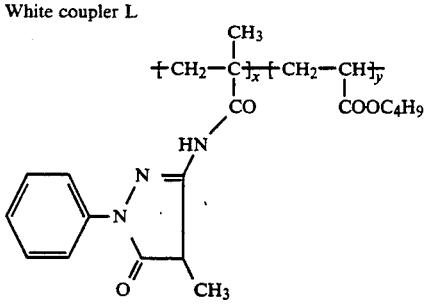

x ~ 60
y ~ 40

Test material B

A test material B was prepared by a similar method but in contrast to test material A, Layer 2 was composed of 0.346 g of white coupler and 0.900 g of gelatine.

The test materials A and B are exposed in a dark chamber with room lighting from a 100 Watt incandescent lamp at a distance of 1.5 m and for an exposure time of 15 minutes.

Development is carried out as described in "The Journal of Photography", 1974, pages 597 and 598, but the developer was diluted with 20 volumes-%.

Modified developers containing the development inhibitor to be tested are prepared by adding to the developer a 0.02 molar solution of the inhibitor in a mixture of methanol/water (8:2) containing NaOH up to a pH of 9 in case required for solution, and diluting the developer to 20 volumes-% by the addition of water.

Test materials A and B are developed in the developer not containing the inhibitor and then processed in the subsequent steps.

The cyan densities obtained are measured with a densitometer.

The diffusibility $D_f$ is determined from the following equation:

$$D_f = \frac{(D_{Ao} - D_A)/D_{Ao}}{(D_{Bo} - D_B)/D_{Bo}}$$

wherein $D_{Ao}$ and $D_{Bo}$ denote the colour density of test materials A and B after development in the given developer without the addition of inhibitor and $D_A$ and $D_B$ denote the colour density of test materials A and B after development in the given developer containing the inhibitor at a concentration conforming to the following equation:

$$\frac{D_{Bo} - D_B}{D_{Bo}} = 0.5$$

Preferred inhibitors have a $D_f$ value $\geqq 0.4$.

Highly diffusible inhibitors to be used according to the invention are indicated below but the DIR compounds used are not limited to these inhibitors.

INH-1

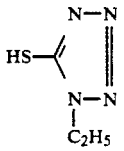

$D_f = 0,48$

INH-2

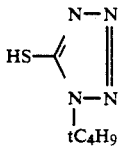

$D_f = 0,40$

INH-3

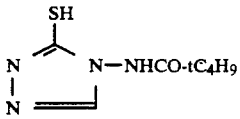

$D_f = 0,76$

INH-4

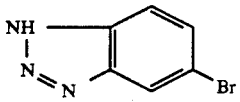

$D_f = 0,90$

INH-5

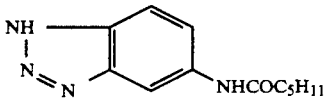

$D_f = 0,84$

-continued

INH-6

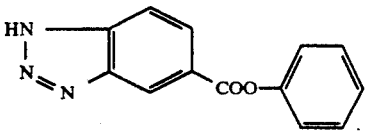

$D_f = 0,74$

INH-7

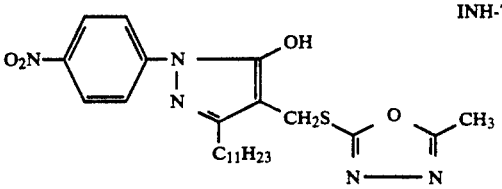

$D_f = 0,45$

INH-8

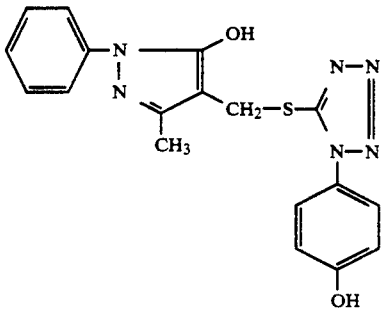

$D_f = 0,59$

INH-9

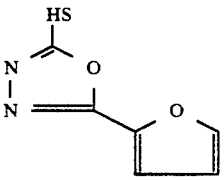

$D_f = 0,54$

INH-10

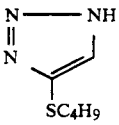

$D_f = 0,67$

INH-11

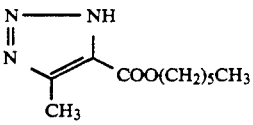

$D_f = 0,47$

INH-12

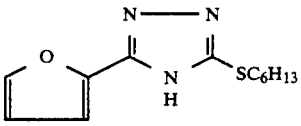

$D_f = 0,63$

The colour photographic silver halide materials according to the invention are processed by development, bleaching and fixing after imagewise exposure.

Suitable colour developer substances for the material according to the invention include in particular those of the p-phenylenediamine series, e.g. 4-amino-N,N-diethylaniline hydrochloride; 4-amino-3-methyl-N-ethyl-N-β-(methanesulphonamido)-ethylaniline sulphate hydrate; 4-amino-3-methyl-N-ethyl-N-β-hydroxyethylaniline sulphate; 4-amino-N-ethyl-N-(2-methoxyethyl)-m-toluidine-di-p-toluene sulphonic acid and N-ethyl-N-β-hydroxyethyl-p-phenylenediamine. Other suitable colour developers are described, for example, in J. Amer. Chem. Soc. 73, 3100 (1951) and in G. Haist, Modern Photographic Processing, 1979, John Wiley and Sons, New York, pages 515 et seq.

The pH of the colour developer is in the range of from 8 to 13, preferably from 9 to 12 and most preferably from 9.5 to 11.5. The temperature is in the range of from 25° to 50° C., preferably from 30° to 50° C. and most preferably from 35° to 45° C. to assist the reduced development time.

It is preferred to use a colour developer which is free from or contains less than 1.0 mg/l of iodide ions. Colour developers which are free from or contain less than 50 mg/l of bromide ions are particularly preferred.

The development time is from 15 seconds to 150 seconds, preferably from 20 to 120 seconds and most preferably from 30 to 90 seconds.

After colour development, the material is bleached and fixed in the usual manner. Bleaching and fixing may be carried out separately or together. The usual bleaching agents may be used, e.g. $Fe^3$-salts and $Fe^3$-complex salts such as ferricyanides, dichromates, water-soluble cobalt complexes, etc. Iron-III complexes of aminopolycarboxylic acids are particularly preferred, in particular the complexes of ethylene diaminotetracetic acid, nitrilotriacetic acid, iminodiacetic acid, N-hydroxyethylethylene diaminotriacetic acid, alkyliminodicarboxylic acids and alanine diacetic acid. Persulphates are also suitable bleaching agents.

The preparation of some emulsions (according to the invention and for comparison) are described below. Emulsions 2 to 4 of pages 3 and 4 are obtained analogously.

Emulsion 1 (Core-Shell $AgCl_{0.7}Br_{0.3}$ Emulsion Containing AgBr in the Core)

1000 ml of an 0.8 molar $AgNO_3$ solution and 1000 ml of an 0.8 molar KBr solution were introduced into 9 liters of an aqueous solution containing 350 g of gelatine, 50 g of NaCl and 120 g of methionine at 65° C. and pH 4.4 by the double injection process with stirring, each component being injected at the rate of 35 ml/min. 3450 ml of a 2-molar $AgNO_3$ solution and 3450 ml of a 2 molar KBr solution were then added in 16 minutes by the double injection process, injection of the silver solution and halide solution being adjusted so that the final speed of injection was 3 times higher than the initial speed. After 15 minutes' tempering at 65° C., the solution was adjusted to 45° C. 6000 ml of a 3 molar $AgNO_3$ solution and 6000 ml of a 3 molar NaCl solution were then added in 25 minutes by the double injection process.

The emulsion was flocculated, washed, redispersed with a solution of 1630 g of gelatine in 8 liters of water and adjusted to pH 6.0 and pAg 8.

The emulsion was chemically ripened to maximum sensitivity at 55° C. with 5 μmol of sodium thiosulphate/mol of Ag, 5-μmol of tetrachlorohydroauric acid and 500 μmol of potassium thiocyanate/mol of Ag.

The emulsion was homodisperse and composed of 2 zones.

Zone 1 (core) of AgBr (30 mol. %)

Zone 2 (shell) of AgCl (70 mol. %).

The silver halide crystals were cubical. The most frequently occurring diameter of spheres of the same volume as the crystals was 1.6 μm, 90% of the crystals having a diameter greater than 1.45 μm and less than 1.8 μm.

Emulsion 5 (Core Shell $AgCl_{0.7}BrO_{0.3}$-emulsion with AgCl in the Core)

1500 ml of 1.35 molar $AgNO_3$ solution and 1500 ml of 1.35 molar NaCl solution were introduced by the double injection process with stirring at 55° C. and pH 4.4 into 9 liters of an aqueous solution containing 350 g of gelatine, 50 g of NaCl and 30 g of methionine, each solution being injected at the rate of 55 ml/min. 5400 ml of a 3-molar $AgNO_3$ solution and 5400 ml of a 3-molar NaCl solution were then injected by the double injection process in the course of 20 minutes. After 10 minutes' tempering at 55° C., 2600 ml of a 3-molar $AgNO_3$ solution and 2600 ml of 3-molar KBr solution were injected at this temperature in 10 minutes at a constant injection rate. The emulsion was flocculated, washed, redispersed and chemically ripened to maximum sensitivity in the same way as Emulsion 1.

The emulsion was homodisperse and composed of 2 zones.

Zone 1 (core) of AgCl (70 mol. %)

Zone 2 (shell) of AgBr (30 mol. %).

The silver halide crystals were cubical. The most frequently occurring diameter of spheres equal in volume to the crystals was 1.56 μm, 90% of the crystals having a diameter greater than 1.50 μm and less than 1.74 μm.

Emulsion 6 ($AgCl_{0.7}BrO_{0.3}$ with the AgBr Content Decreasing from the Inside to the Outside)

A silver chlorobromide emulsion composed of 11 zones and containing 30 mol. % of AgBr in the core and 70 mol. % of AgCl not present at the centre of the silver halide crystals was prepared by the double and triple injection process as described below.

1060 ml of a 0.5-molar $AgNO_3$-solution and 1060 ml of a 0.5-molar KBr solution were added by the double injection process with stirring at 63° C. and pH 6.3 to 13.5 liters of an aqueous solution containing 230 g of gelatine, 0.8 g of potassium bromide and 20 g of methionine, each solution being injected at the rate of 100 ml/min. A homodisperse, cubical AgBr emulsion whose crystals had a length of edge of 0.4 μm was obtained after 20 minutes' tempering at 63° C.

770 g of gelatine, 50 g of NaCl and 80 g of methionine were added to this starting emulsion. 800 ml of a 2-molar $AgNO_3$ solution, 4000 ml of a 2-molar KBr solution and 4000 ml of a 2-molar NaCl solution were then added by the triple injection process, the $AgNO_3$ solution being added in 9 stages in the course of 45 minutes at increasing injection rates so that the final injection rate was 5 times higher than the initial injection rate. The injection rate of the KBr solution was adjusted so that the KBr/$AgNO_3$ molar ratio varied from 0.9 to 0.1 in 9 stages corresponding to the sequence of the injection stages of the $AgNO_3$ solution. The injection rate of the NaCl solution was adjusted so that the total molar number of KBr and NaCl was equal to that of $AgNO_3$.

6820 ml of a 3-molar $AgNO_3$ solution and 6820 ml of a 3-molar NaCl solution were then added in the course of 15 minutes by the double injection process.

The emulsion was flocculated, washed, redispersed and chemically ripened to maximum sensitivity in the same way as Emulsion 1.

The emulsion was built up of the following 11 zones, counting from the inside to the outside:

| | | | |
|---|---|---|---|
| Zone | I | of AgBr | 1.45 mol-% |
| | II | Ag $Cl_{0.1}Br_{0.9}$ | 2.55 mol-% |
| | III | Ag $Cl_{0.2}Br_{0.8}$ | 3.82 mol-% |
| | IV | Ag $Cl_{0.3}Br_{0.7}$ | 5.1 mol-% |
| | V | Ag $Cl_{0.4}Br_{0.6}$ | 6.37 mol-% |
| | VI | Ag $Cl_{0.5}Br_{0.5}$ | 7.64 mol-% |
| | VII | Ag $Cl_{0.6}Br_{0.4}$ | 8.92 mol-% |
| | VIII | Ag $Cl_{0.7}Br_{0.3}$ | 10.2 mol-% |
| | IX | Ag $Cl_{0.8}Br_{0.2}$ | 11.45 mol-% |
| | X | Ag $Cl_{0.9}Br_{0.1}$ | 12.73 mol-% |
| | XI | Ag Cl | 29.77 mol-% |

The silver halide crystals were cubical with rounded corners. The most frequently occurring diameter of the corresponding spheres was 1.84 μm, 90% of the crystals having a diameter > 1.50 μm and < 2.10 μm.

Emulsion 7 ($AgCl_{0.7}BrO_{0.3}$ with Homogeneous Halide Distribution; Comparison Emulsion)

1500 ml of a 1.35 molar $AgNO_3$ solution and 1500 ml of a 1.35 molar halide solution (70 mol. % NaCl and 30 mol. % KBr) were added by the double injection process with stirring at 55° C. and pH 4.4 to 9 liters of an aqueous solution containing 350 g of gelatine, 50 g of NaCl and 60 g of methionine, each solution being injected at the rate of 55 ml/min. After 10 minutes' tempering at 55° C., 8000 ml of a 3 molar $AgNO_3$ solution and 8000 ml of a 3 molar halide solution (70 mol. % NaCl and 30 mol. % KBr) were added by the double injection process in the course of 45 minutes at increasing rates so that the final rate of injection of the solution of silver ions and solution of halide ions was 4 times greater than the initial injection rate. The emulsion was flocculated, washed, redispersed with a solution of 1630 g of gelatine in 8 liters of $H_2O$ and adjusted to pH 6.0 and pAg 8.

The emulsion was flocculated, washed, redispersed and chemically ripened to maximum sensitivity as in the case of Emulsion 1.

The emulsion was homodisperse and homogeneously composed of 70 mol. % of AgCl and 30 mol. % of AgBr. The silver halide crystals were cubical. The most frequently occurring diameter of the corresponding spheres was 1.8 μm, with 90% of the crystals having a diameter > 1.75 μm and < 1.85 μm.

EXAMPLES

Example 1

The following layers were applied in the sequence given here to a transparent layer support of cellulose triacetate (quantities given per $m^2$):

The quantities of silver halide applied are given in terms of the corresponding quantities of $AgNO_3$.

All silver halide emulsions of this material were stabilized with 0.5 g of 4-hydroxy-6-methyl-1,3,3a,7-tetraazaindene per 100 g of $AgNO_3$.

| | |
|---|---|
| Layer arrangement 1A | |
| 1st Layer | (green sensitive layer)<br>2.50 g of $AgNO_3$ of the spectrally green-sensitized Emulsion 7<br>1.13 g of gelatine<br>0.62 g of magenta coupler M1<br>0.62 g of tricresylphosphate |
| 2nd Layer | (protective and hardening layer)<br>1.14 g of gelatine<br>0.40 g of hardener |
| Layer arrangement 1B | |
| same as layer arrangement 1A but with the addition of 0.054 g of DIR-1 to the first layer | |
| Layer arrangement 1C | |
| same as layer arrangement 1A but with the addition of 0.051 g of DIR-2 to the first layer | |
| Layer arrangement 1D | |
| same as layer arrangement 1A but with 2.5 g of $AgNO_3$ in green sensitized Emulsion 5 instead of 2.5 g of $AgNO_3$ in Emulsion 7 | |
| Layer arrangement 1E | |
| same as layer arrangement 1B but with 2.5 g of $AgNO_3$ in green sensitized Emulsion 5 instead of 2.5 g of $AgNO_3$ in Emulsion 7 | |
| Layer arrangement 1F | |
| same as layer arrangement 1C but with 2.5 g of $AgNO_3$ in green sensitized Emulsion 5 instead of 2.5 g of $AgNO_3$ in Emulsion 7 | |
| Layer arrangement 1G | |
| same as layer arrangement 1A but with 2.5 g of $AgNO_3$ in green sensitized Emulsion 1 instead of 2.5 g of $AgNO_3$ in Emulsion 7 | |
| Layer arrangement 1H | |
| same as layer arrangement 1B but with 2.5 g of $AgNO_3$ in green sensitized Emulsion 1 instead of 2.5 g of $AgNO_3$ in Emulsion 7 | |
| Layer arrangement 1I | |
| same as layer arrangement 1C but with 2.5 g of $AgNO_3$ in green sensitized Emulsion 1 instead of 2.5 g of $AgNO_3$ in Emulsion 7 | |
| Layer arrangements 1H and 1I are according to the invention. | |

Compounds used in Example 1:

M1

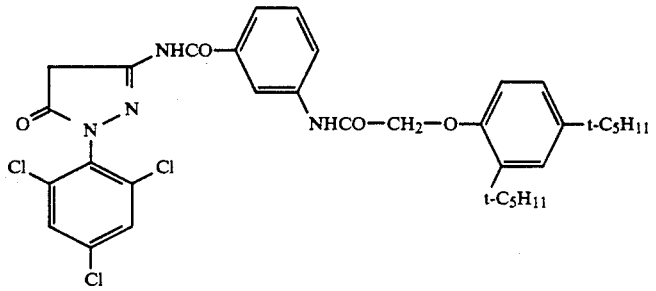

-continued

DIR 1

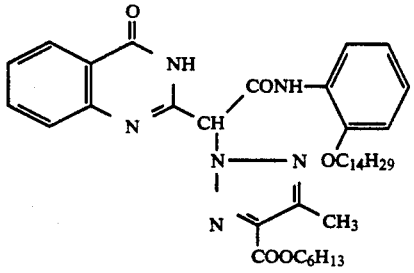

DIR 2

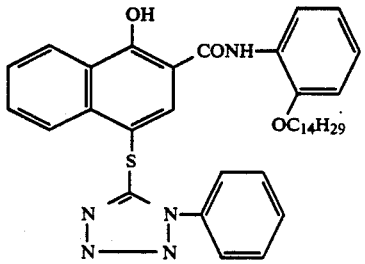

Hardener $CH_2{=}CH{-}SO_2{-}CH_2{-}CONH{-}CH_2$
$CH_2{=}CH{-}SO_2{-}CH_2{-}CONH{-}CH_2$ These nine layer arrangements 1A to 1I were used to determine the decline in gradation caused by using DIR couplers as standardized inhibition I.

$$I = \frac{\gamma \text{ without } DIR - \gamma \text{ with } DIR}{\gamma \text{ without } DIR}$$

Large values for inhibition are necessary for obtaining great sharpness by edge effects. On the other hand, decline in sensitivity by using DIR couplers is undesirable. The amount of the "edge effects" was determined by X-ray irradiation according to T. H. James, The Theory of the Photographic Process, 4th Edition, Macmillan Publishing Comp. Inc. New York, London (1977), pages 609–614: using one sample of each layer arrangement 1 A to 1 I, both a macro field and a strip 30 μm in width were exposed to the same X-ray dose. The samples were then processed by the colour negative process described in "The British Journal of Photography", 1974, pages 597 and 598. The density differences between the strip (=microdensity) and the macro field (=macrodensity) of these samples at the X-ray dose which produces the macrodensity of 0.8 above fog serves as measure of the edge effect in Table 1.

High edge effects are required for good reproduction of detail.

Table 1 shows the values for regression in sensitivity ΔE obtained by using DIR couplers compared with the sample free from DIR couplers, and the inhibition I and edge effect K.

TABLE 1

| Layer arrangement | ΔE (DIN) | I | K |
|---|---|---|---|
| 1A Comparison | — | — | 0.02 |
| 1B Comparison | 6.8 | 3 | 0.04 |
| 1C Comparison | 4.3 | 10 | 0.12 |
| 1D Comparison | — | — | 0.01 |
| 1E Comparison | 3.6 | 9 | 0.12 |
| 1F Comparison | 1.4 | 12 | 0.16 |
| 1G Comparison | — | — | 0.02 |
| 1H invention | 3.0 | 33 | 0.40 |

TABLE 1-continued

| Layer arrangement | ΔE (DIN) | I | K |
|---|---|---|---|
| 1J invention | 3.6 | 66 | 0.35 |

EXAMPLE 2

Layer arrangement 2A

1st Layer (red sensitive layer)
3.80 g of $AgNO_3$ of the spectrally red sensitized Emulsion 7
2.66 g of gelatine
0.95 g of cyan coupler C 1
0.95 g of tricresyl phosphate 2nd Layer (separating layer)
1.50 g of gelatine
0.80 g of white coupler Wl 3rd Layer (green sensitive layer)
3.80 g of $AgNO_3$ of the spectrally green sensitized Emulsion 7
2.85 g of gelatine
0.95 g of magenta coupler Ml
0.95 g of tricresyl phosphate 4th Layer (protective and hardening layer)
1.14 g of gelatine
0.52 g of hardener Layer arrangement 2B Same as layer arrangement 2A but with 3.8 g of $AgNO_3$ of red sensitized Emulsion 1 instead of 3.8 g of $AgNO_3$ of Emulsion 7 in the first layer and 3.8 g of $AgNO_3$ of green sensitized Emulsion 1 instead of 3.8 g of $AgNO_3$ of Emulsion 7 in the third layer.

Layer arrangement 2C

Same as layer arrangement 2A but with the addition of 0.054 g of DIR-1 both to the 1st and the 3rd layer Layer arrangement 2D Same as layer arrangement 2B but with the addition of 0.054 g of DIR-1 both to the 1st and the 3rd layer Layer arrangement 2E Same as layer arrangement 2A but with the addition of 0.055 g of DIR-3 both to the 1st and the 3rd layer Layer arrangement 2F Same as layer arrangement 2B but with the addition of 0.055 g of DIR-3 both to the 1st and the 3rd layer -continued Layer arrangement 2D is according to the invention.

Compounds used for the first time in Example 2:

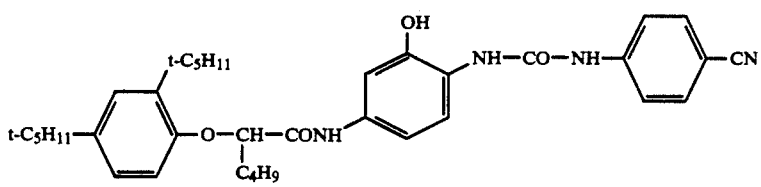

C1

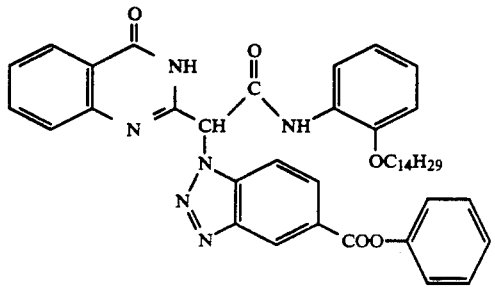

DIR 3

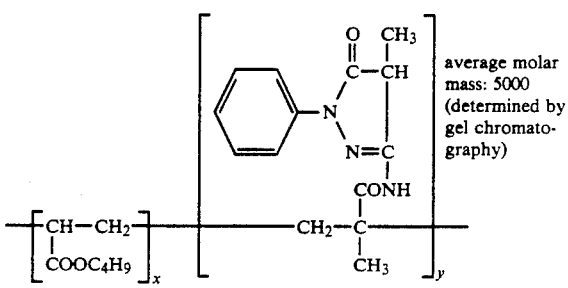

average molar mass: 5000 (determined by gel chromatography)

W1 x = 40% y = 60%

The interimage effect (IIE) of cyan and magenta, which improves the colour quality, is also enhanced by the combination according to the invention (2 D). The interimage effects entered in Table 2 denote the number of percent by which the magenta gradation and cyan gradation are greater after exposure to green light or red light than after exposure to white light at that point of the colour density curve where the colour density obtained with white exposure is 1.0 above fog.

Table 2 shows the values for the edge effects and interimage effects.

TABLE 2

| Layer arrangement | Edge effect at macro-density 1.0 above fog | | IIE | |
|---|---|---|---|---|
| | Magenta | Cyan | Magenta | Cyan |
| 2A | −4 | −5 | 0 | 4 |
| 2B | −3 | 0 | 2 | 4 |
| 2C | 14 | 20 | 10 | 15 |
| 2D | 56 | 40 | 35 | 78 |
| 2E | −3 | 4 | 3 | 4 |
| 2F | 10 | 12 | 5 | 12 |

EXAMPLE 3

Layer arrangement 3A

| | |
|---|---|
| 1st Layer | (red-sensitive layer) |
| | 3.80 g of $AgNO_3$ of spectrally red sensitized Emulsion 1 |
| | 2.70 g of gelatine |
| | 0.95 g of cyan coupler C1 |
| | 0.95 g of tricresyl phosphate |
| 2nd Layer | (separating layer) |
| | 1.5 g of gelatine |
| | 0.80 g of white coupler W1 |
| 3rd Layer | (green-sensitive layer) |
| | 3.5 g of $AgNO_3$ of spectrally green sensitized Emulsion 1 |
| | 2.6 g of gelatine |
| | 0.95 g of magenta coupler M1 |
| | 0.95 g of tricresyl phosphate |
| 4th Layer | (separating layer) |
| | 1.50 g of gelatine |
| | 0.80 g of white coupler W1 |
| 5th Layer | (yellow filter layer) |
| | 0.36 g of gelatine |
| | 0.09 g of yellow colloidal silver sol |
| 6th Layer | (blue-sensitive layer) |
| | 3.8 g of $AgNO_3$ of spectrally blue sensitized Emulsion 1 |
| | 2.6 g of gelatine |
| | 1.0 g of yellow coupler Y1 |
| | 1.0 g of tricresyl phosphate |
| 7th Layer | (protective layer) |
| | 1.50 g of gelatine |
| 8th Layer | (hardening layer) |
| | 1.14 g of gelatine |
| | 0.75 g of hardener |

Layer arrangement 3B

Same as layer arrangement 3A but with the addition of 53 mg of DIR-1 to the 1st Layer, the addition of 49 mg of DIR-1 to the 3rd Layer and the addition of 55 mg of DIR-1 to the 6th Layer.

Substances used for the first time in Example 3:

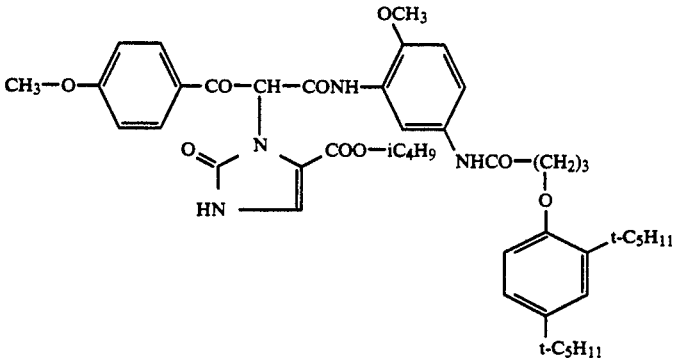

Y1

The samples are exposed to reflected light from a grey wedge.

Processing was carried out as shown in Tables 3 and 4.

TABLE 3

| Processing step | Duration | Temperature | Volume of tank | Replenishment quota*) |
|---|---|---|---|---|
| Colour development | 60 s | 38° C. | 4 l | 390 ml |
| Bleach fixing | 60 s | 38° C. | 4 l | 580 ml |
| First washing | 15 s | 38° C. | 2 l | overflow from 2nd washing |
| Second washing | 15 s | 38° C. | 2 l | 390 ml |
| Drying | 30 s | 65° C. | | |

*)ml per $m^2$ of material passed through

| Colour developer | Stock solution | Replenishing solution |
|---|---|---|
| Water | 900 ml | 900 ml |
| Potassium chloride | 1.0 g | 1.0 g |
| Potassium carbonate | 34.6 g | 38.0 g |
| Sodium bicarbonate | 1.8 g | 2.0 g |
| Ethylene diamine-N,N,N,N-tetra-methylene-phosphonic acid | 1.0 g | 1.2 g |
| Triethylenediamine | 5.3 g | 6.0 g |
| Diethylhydroxylamine | 4.2 g | 5.5 g |
| 3-Methyl-4-amino-N-ethyl-N-β-hydroxyethyl-anilin sulphate (CD 4) | 4.6 g | 7.5 g |
| Potassium hydroxide for the adjustment of | pH 10.05 | pH 10.05 |
| made up with water to | 1 l | 1 l |

| Bleach fixing bath | Stock and replenishing solution |
|---|---|
| Iron-ammonium-ethylenediamino-tetraacetate dihydrate | 90.0 g |
| Disodium-ethylenediaminotetra-acetate | 10.0 g |
| Sodium sulphite | 12.0 g |
| Ammonium thiosulphate solution (aqueous, 70% by weight) | 260.0 ml |
| 2-Mercapto-5-amino-thiadiazole | 0.01 mol |
| Acetic acid (98% by weight for adjustment of | pH 5.5 |
| made up with water to | 1.0 l |

TABLE 4

| Processing step | Duration | Temperature | Volume of tank | Replenishment quota*) |
|---|---|---|---|---|
| Colour development | 30 s | 42° C. | 4 l | 390 ml |
| Bleach fixing | 30 s | 42° C. | 4 l | 580 ml |
| First washing | 10 s | 42° C. | 2 l | overflow from 2nd washing |
| Second washing | 10 s | 42° C. | 2 l | 390 ml |
| Drying | 30 s | 65° C. | | |

*)ml per $m^2$ of material passing through

| | Stock solution | Replenishment solution |
|---|---|---|
| Colour developer | | |
| Water | 900 ml | 900 ml |
| Potassium chloride | 2.0 g | 2.0 g |
| Potassium carbonate | 34.6 g | 38.0 g |
| Sodium bicarbonate | 1.0 g | 1.5 g |
| Ethylene diamine-N,N,N,N-tetra-methylene-phosphonic acid | 2.0 g | 2.4 g |
| 1,4-Diazabicyclo[2.2.2]octane | 5.3 g | 6.0 g |
| Diethylhydroxylamine | 4.2 g | 5.5 g |
| 3-Methyl-4-amino-N-ethyl-N-β-hydroxyethyl-anilin sulphate | 6.0 g | 8.0 g |
| Potassium hydroxide for adjustment of | pH 10.2 | pH 10.3 |
| made up with water to | 1000 ml | 1000 ml |
| Bleach fixing bath | | |
| Water | 600 ml | 600 ml |
| Iron-ammonium-ethylenedi-amino-tetraacetate-dihydrate | 90 g | 100 g |
| Disodium ethylenediamino-tetraacetate | 10 g | 10 g |
| Ammonium sulphite | 10 g | 12 g |
| Ammonium thiosulphate solution (aqueous, 70%) | 260 ml | 270 ml |
| 2-Mercapto-5-amino-thiadiazole | 0.01 mol | 0.015 mol |
| Acetic acid for adjustment of | pH 5.5 | pH 5.0 |
| made up with water to | 1 l | 1 l |

The edge effect K was determined at macrodensity 1.0 above fog.

| | I | | | K | | | IIE | | |
|---|---|---|---|---|---|---|---|---|---|
| | Yellow | Magenta | Cyan | Yellow | Magenta | Cyan | Yellow | Magenta | Cyan |
| Process according to Table 3 | 34 | 50 | 45 | 42 | 53 | 70 | 10 | 36 | 39 |
| Process according to Table 4 | 31 | 45 | 50 | 40 | 55 | 75 | 12 | 34 | 40 |

EXAMPLE 4

Layer arrangement 4A

-continued

| | |
|---|---|
| 1st Layer | (green sensitive layer)<br>1.50 g of $AgNO_3$ of spectrally green sensitized emulsion 1<br>1.13 g of gelatine<br>0.62 g of magenta coupler M1<br>0.62 g of tricresyl phosphate |
| 2nd Layer | (protective and hardening layer)<br>1.14 g of gelatine<br>0.40 g of hardener |
| Layer arrangements 4B to 4G | |
| Same as layer arrangement 4A but with the addition in the 1st Layer of 2 mmol of DIR compound DIR-1, DIR-2, DIR-3, DIR-4, DIR-5 or DIR-6. | |

Compounds used for the first time in Example 4:

DIR-4

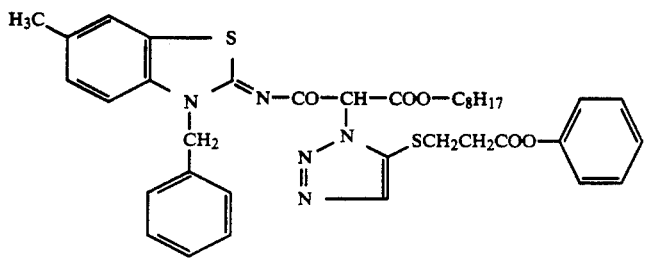

DIR-5

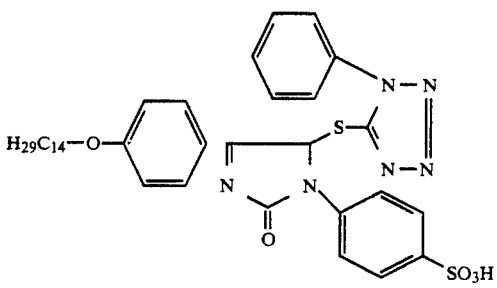

DIR-6

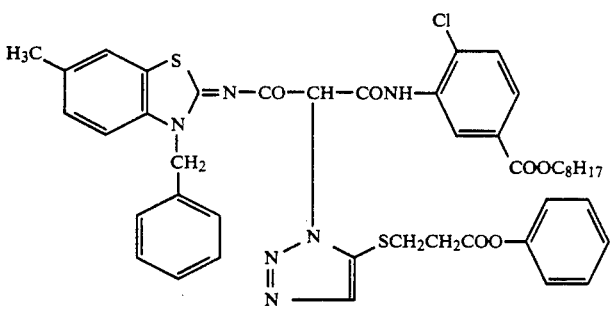

Table 5 shows the inhibitions I measured:

TABLE 5

| Layer arrangement | DIR compound | k [l/mol.s] | I |
|---|---|---|---|
| 4 A | — | — | — |
| 4 B invention | DIR-1 | 4000 | 57 |
| 4 C invention | DIR-2 | 8000 | 57 |
| 4 D comparison | DIR-3 | 1800 | 10 |
| 4 E comparison | DIR-4 | 160 | 7 |
| 4 F comparison | DIR-5 | 1000 | 17 |
| 4 G invention | DIR-6 | 3900 | 45 |

We claim:

1. Colour photographic material having at least one silver halide emulsion layer containing at least one colour coupler, spectrally sensitized silver halide grains having a total silver chloride content from 40 to 90 mol %, said silver halide grains having at least two zones differing in halide composition, the outer zone having a chloride content at least 10 mol % higher than that in the inner zone, and a DIR compound whose reaction with the oxidized colour developer has an effective rate constant, k, >2000 [1/mol.s].

2. Colour photographic silver halide material according to claim 1 in which the silver halide grains are AgBrCl grains.

3. Colour photographic silver halide material according to claim 1, in which the silver halide emulsion is monodisperse, at least 70% of the spheres having the same volume as the emulsion grains have diameters with a value from 0.8 times to 1.9 times the most frequently occurring sphere diameter.

4. Colour photographic silver halide material according to claim 1 having at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler.

5. Colour photographic silver halide material according to claim 4, in which at least one red-sensitive, at least one green sensitive and at least one blue-sensitive silver halide emulsion layer contains a silver halide emulsion and a DIR compound.

6. Colour photographic silver halide material according to claim 1, characterized in that the effective rate constant, k, of the DIR compound is $>5\times10^3$ [1/mol.s].

7. Colour photographic silver halide material according to claim 1, characterized in that the DIR compounds have a diffusibility $\geqq 0.4$.

* * * * *